United States Patent [19]

Holzkopf

[11] Patent Number: 4,741,452

[45] Date of Patent: May 3, 1988

[54] DOMED CONTAINER WITH INTERLOCKING RESILIENT FLANGES

[75] Inventor: Michael E. Holzkopf, Libertyville, Ill.

[73] Assignee: Ekco Products, Inc., Wheeling, Ill.

[21] Appl. No.: 729,654

[22] Filed: May 2, 1985

[51] Int. Cl.[4] ..... B65D 41/18

[52] U.S. Cl. ..... 220/306; 150/55; 206/45.32; 220/356; 312/284

[58] Field of Search ..... 220/306, 307, 355, 356, 220/366, 293, 305, 4 B; 229/2.5 R, 43; 150/55; 206/45.32, 45.19; 312/284

[56] References Cited

U.S. PATENT DOCUMENTS

| | | | |
|---|---|---|---|
| Re. 28,059 | 7/1974 | Mounts et al. | 150/55 X |
| 2,246,695 | 6/1941 | Phillips | 206/45.32 |
| 2,530,910 | 11/1950 | Schnabel | 312/284 X |
| 2,914,104 | 11/1959 | Jocelyn | 220/307 X |
| 3,590,988 | 7/1971 | Hollar | 220/306 X |
| 3,690,902 | 9/1972 | Dahl | 312/284 X |
| 3,770,115 | 11/1973 | Cannell | 206/45.32 |
| 3,815,736 | 6/1974 | Sedlak | 229/2.5 R X |
| 3,912,118 | 10/1975 | Bird | 220/306 |
| 3,964,635 | 6/1976 | Ludder | 220/306 |
| 4,197,940 | 4/1980 | DeRossett | 206/45.32 |
| 4,206,845 | 6/1980 | Christian | 150/55 X |
| 4,375,862 | 3/1983 | Kurinsky et al. | 220/306 X |

*Primary Examiner*—Stephen Marcus
*Assistant Examiner*—Bryon Gelman
*Attorney, Agent, or Firm*—Neuman, Williams, Anderson & Olson

[57] ABSTRACT

The combination of a domed cover for a container wherein the cover has an outwardly biased flange designed to flex inward to snap-lock disposition with an inwardly biased rim of the underlying container, and a skirt portion formed intermediate the flange and the walls of the cover.

3 Claims, 2 Drawing Sheets

DOMED CONTAINER WITH INTERLOCKING RESILIENT FLANGES

BACKGROUND OF THE INVENTION

This invention relates to disposable containers having covers and particularly to such a container wherein the cover is releasably interlocked with the container by "snap-lock" closure means.

In the use of covered containers to package, distribute and display bakery goods such as cakes, it is desirable that the cover be of a transparent material to permit visual inspection of the cake within the package. Therefore, and since the package is intended to be disposable, the cover is normally formed of a see-through plastic material. Securement of the cover to the container can be achieved by heat sealing, sealing tape or stapling, although these types of closures are relatively expensive. A less expensive closure can be achieved by forming the cover to provide a depending flange to "snap-over" the rim of the underlying container, although this usually results in a loose or otherwise ineffective closure.

The inexpensive "snap-over" closure is considered a desirable closure because of the simplicity involved in effecting the interlock between the cover and container. Basically, all that is required is placing the cover on the container and exerting downward pressure on the cover, However, the resultant closure is still a loose-fitting and ineffective closure. The cause of the loose-fitting closure is believed to be the movement of the container side and end walls inwardly and away from the cover flange due to downwardly flexing of the container bottom wall resulting from the weight of the cake in the container.

Accordingly, it is the primary object of this invention to provide a "snap-lock" type of closure for locking a cover to a container in a manner that would result in an effective, close fitting interlock between the cover and the container.

SUMMARY OF THE INVENTION

The proposed container and cover construction contemplate a "snap-lock" closure means wherein the container is formed to provide an upwardly extending outer rim and the cover has an outwardly extending flange portion designed to flex inwardly whereby, upon downward movement of the cover, the container rim "snaps-over" the cover flange. The interlocking achieved by trapping the cover flange "inside" of the container rim rather than "outside" of said rim works to provide a tight-fitting closure since the weight of the packaged cake in flexing the container bottom downwardly will urge the container side walls inwardly. The inward bias of the container rim complements the outward bias of the cover flange to maintain an effective closure.

In producing a workable closure in which the cover flange is manipulated to snap-lock inside of the container rim, the cover flange must be flexible enough to be distorted peripherally inward during downward movement of the cover yet rigid enough in locked position to resist inward distortion during upward movement of the cover. This rigidity in the locked position has normally been maintained by the formation of an upwardly extending rib in the container bottom positioned to abut the inner portion of the cover flange when it is in the locked position thereby providing a resistance to inward movement of the cover flange.

The inward flexing of the cover flange is also inhibited by vertical fluting of the cover side walls and when manipulation forceful enough for closure release is undertaken, it often results in deformation or collapse of the cover side walls. The provision of a shoulder portion between the cover side wall and the cover flange is desirable to permit the necessary flexing of the cover flange without transmitting the manipulative force to the side wall itself.

Other objects and advantages will become apparent from the description of the preferred embodiment.

DESCRIPTION OF THE PREFERRED EMBODIMENT

Figure 1:
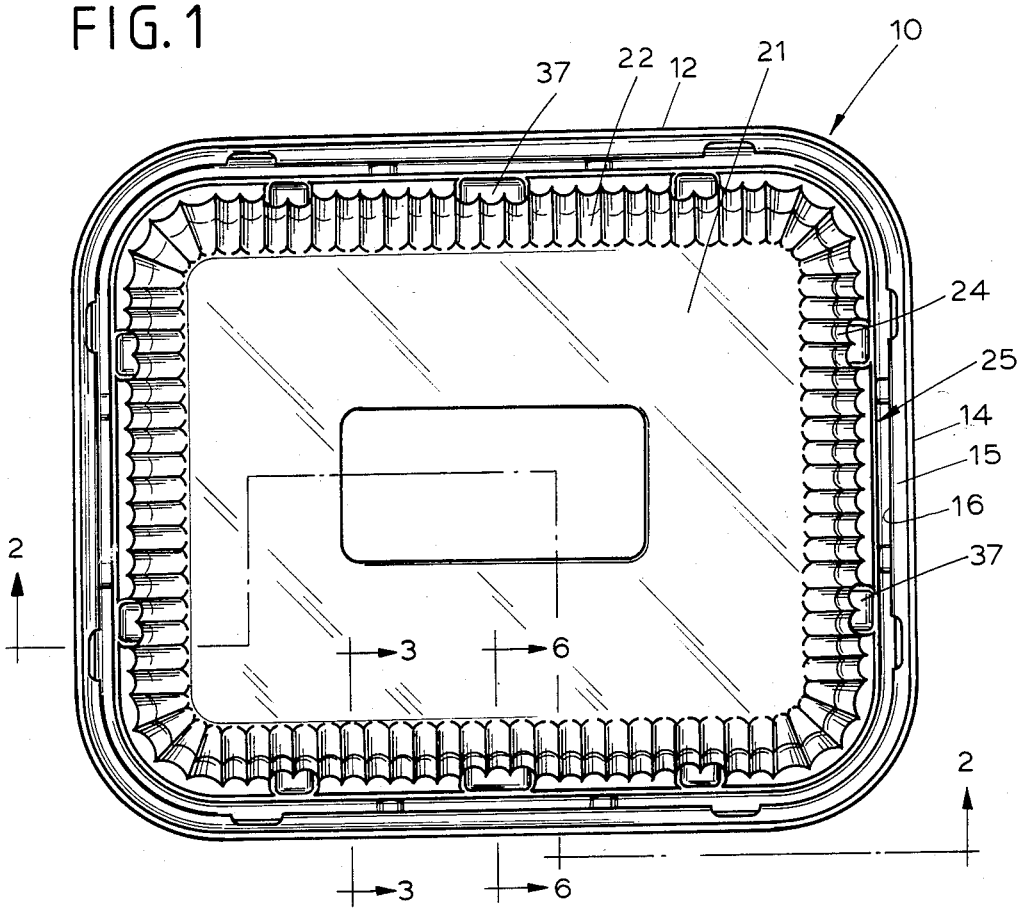
FIG. 1 is a plan view of a container and cover embodying the features of the invention set forth herein.
Figure 2:
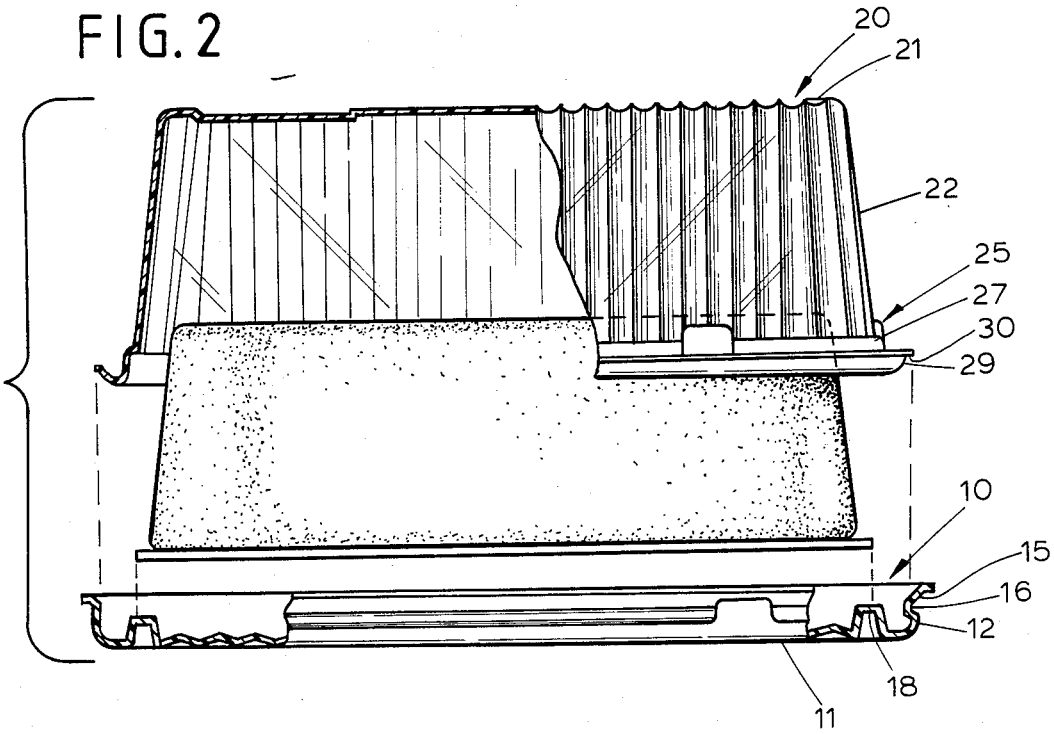
FIG. 2 is an exploded side elevational view of the container and cover of FIG. 1 with parts broken away along line 2—2 of FIG. 1.

Referring now to the drawings and particularly FIGS. 1 and 2, the reference numeral 10 indicates a rectangular-shaped container comprising a bottom wall 11 having opposed side walls 12 and opposed end walls 14 extending upwardly therefrom, said side and end walls terminating in an outwardly extending rim 15. The rim 15 has a shoulder 16 formed at the juncture of the rim and the respective side wall 12 and end wall 14. The bottom wall 11 is formed to provide a rectangular-shaped rib 18 extending upwardly therefrom and spaced inwardly from said side walls 12 and said end walls 14. As shown in FIGS. 2–5, the rib 18 is formed by upwardly extending inner and outer walls having the upper edges thereof interconnected by an elevated horizontally oriented top surface.

Figure 3:
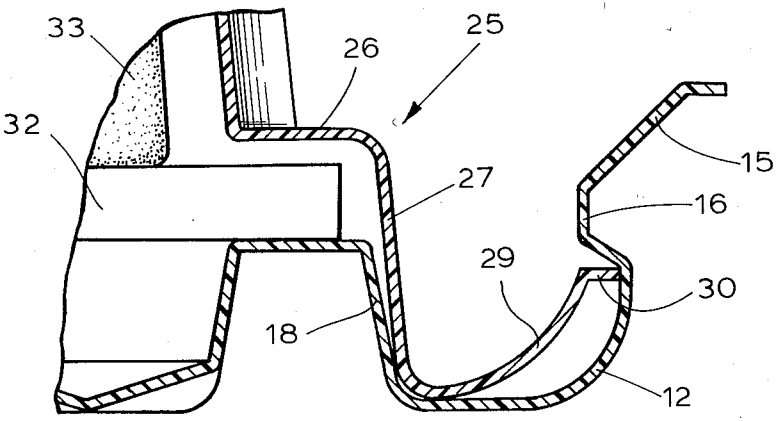
FIG. 3 is an enlarged sectional view taken along line 3—3 of FIG. 1.

The reference numberal 20 indicates a rectangular-shaped cover comprising a top wall 21 having opposed side walls 22 and opposed end walls 24 depending therefrom, said side and end walls terminating in an outwardly and downwardly extending skirt member indicated generally by the reference numeral 25. The skirt member 25 comprises an outwardly extending ledge 26, a leg 27 extending downwardly from said ledge and formed at its lowermost portion to provide an outwardly and upwardly curved flange 29, said flange terminating in an outwardly extending lip 30. The reference numeral 32 indicates a rectangular-shaped board member having a cake 33 positioned thereupon. As seen in FIGS. 2 and 3, the top panel 21, depending walls 22, 23, skirt member 25 and flange 29 of the dome cover are of substantially uniform thickness.

Referring now to FIG. 3 there is shown on an enlarged scale the means for interlocking the cover 20 to the container 10. As shown, the outwardly extending lip 30 of cover flange 29 is disposed under the inwardly extending shoulder 16 of the container rim 15. The leg 27 which abuts the container rib 18 cannot move inwardly thereby maintaining the lip 30 under the shoulder 16.

Figure 4:
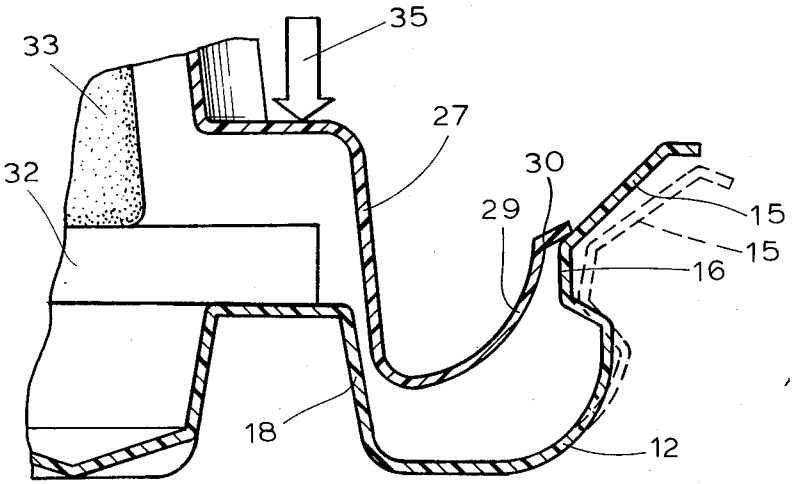
FIG. 4 is a view similar to FIG. 3 but showing the cover flange in the process of flexing during downward movement of the cover and prior to interlocking with the container rim.

As shown in FIG. 4, the interlocking of the cover 20 to the container 10 is accomplished primarily through the inward flexing of cover flange 29 towards the leg 27 of the skirt member 25. Because the depending leg 27 is disposed in substantially face to face engagement with the outer wall of the container rib, the leg 27 will be substantially reinforced by the rib outer wall against inward flexing. Downward movement of the cover, indicated by reference numeral 35, places the flange lip 30 into abutment with container rim 15 and the resulting camming action flexes the cover flange inwardly. Such camming action also acts to flex the container rim 15 outwardly as indicated by the dotted line. The simultaneous inward flexing of cover flange 29 and outward flexing of rim 15 is sufficient to permit downward movement of the lip 30 into disposition below the rim shoulder 16. The inherent bias of flange 29 outwardly and rim 15 inwardly results in the entrapment of flange lip 30 by the rim shoulder 16 as seen in FIG. 3.

Figure 5:
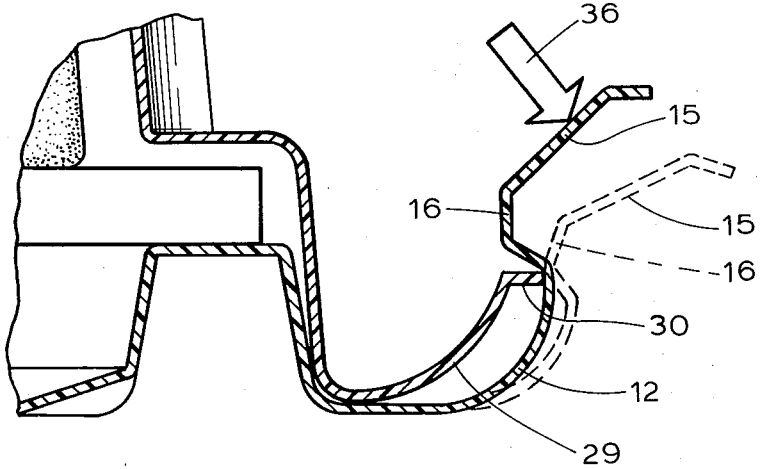
FIG. 5 is a view similar to FIG. 3, but showing the flexing of the container rim necessary to permit release of the cover flange.

Referring now to FIG. 5, the reference numeral 36 indicates force applied to the container rim 15 to flex said rim outwardly to the dotted line position shown, thereby moving rim shoulder 15 away from abutting engagement with flange lip 30 and permitting upward movement of the cover 20. It should be understood that the downward movement of cover 20 as described with respect to FIG. 4 causes inward flexing of the entire flange 29 as well as outward flexing of the entire rim 15 since the force applied to the cover is transmitted through the walls 22 and 24 to substantially the entire cover flange 29 and through said flange to substantially the entire container rim 15. Contrariwise, hand manipulation to flex the container rim 15 outwardly as described with respect to FIG. 5 is accomplished by using the thumb and forefinger to release flange lip 30 from abutting engagement with rim shoulder 16 and is confined initially to one point or area of the rim 15. Thumb pressure moves the rim 15 downwardly and outwardly permitting the consumer to slide a thumb under the flange lip 30, prying the lip upward by sliding the thumb laterally along the rim until the interlock between the flange lip 30 and rim shoulder 16 is interrupted sufficiently to remove the cover completely. It should be noted that the height of the upstanding rib 18 is approximately the same as the height of the shoulder 16. Thus, prying of the consumer's thumb can move the cover flange upwardly sufficiently to clear the rib 18. The set back of cake board 32 coupled with the upward inward taper of rib 18 is adequate to permit some distortion of the flange 29 inwardly. Such flange distortion is useful in implementing the prying action to achieve complete release of the flange lip 30 from the rim shoulder 16. In this regard, it should also be noted that lateral movement of the cake board 32 will not move the cake 33 into contact with the opposing cover wall since the cake is set inwardly from the board edge a distance greater than the distance of the board edge from the leg 27.

Figure 6:
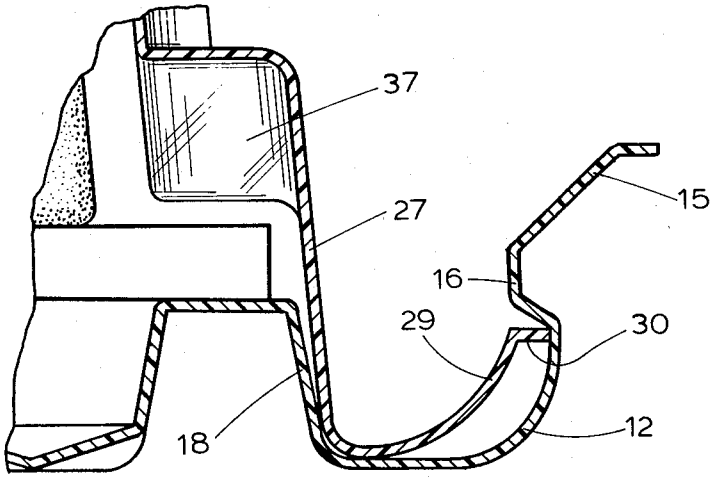
FIG. 6 is an enlarged sectional view taken along line 6—6 of FIG. 1.

As shown in FIG. 1, a multiplicity of bosses 37 are formed in the side walls 22 and end walls 24 of the cover 20. As best seen in FIG. 6, each boss 37 comprises an upward extension of leg 27 and adds rigidity to the skirt 25 whereby flexing of cover flange 29 is not transmitted to the side walls 22 and end walls 24. Clearly, the bosses 37 are upward extensions of ledge 26 and as such can be areas to which downward forces can be applied when seating the cover 20 onto the container 10.

It is believed that the invention and many of its attendant advantages can be understood from the foregoing description and it will be apparent that various changes may be made in the form, construction and arrangement of parts without departing from the spirit and scope of the invention, the form hereinabove described being merely a preferred embodiment.

What is claimed is:

1. The combination of a container and a dome cover therefor having locking means for releasably locking the cover to the container, said container comprising a bottom surface delimited by an upstanding rib and terminating in an outwardly extending resilient rim wherein said rim is outwardly yieldable, said rim encompassing in spaced relation said rib and being provided with an inwardly extending shoulder, and a first camming surface formed on said rim and extending outwardly and upwardly from said shoulder; said dome cover comprising a top surface having at least one wall depending therefrom and terminating in an outwardly extending resilient flange adapted to underlie said shoulder in abutting locking engagement therewith preventing movement of said dome cover relative to said container, a second camming surface formed on the exterior of said flange, and an outwardly and downwardly extending skirt member formed inwardly from said flange and interconnecting said flange and depending wall, said skirt member including a laterally extending ledge section, said flange being in substantially encompassing outwardly spaced relation with said skirt member; when said cover is moved towards said container to effect locking engagement therewith, said first and second camming surfaces initially coacting with one another causing said rim to be deformed outwardly and said flange to be deformed inwardly towards said skirt member while the latter is substantially reinforced by a portion of said rib until said flange abuttingly engages the underside of said shoulder; when said cover and container are in interlocking engagement, the ledge section of said skirt member being disposed in substantially superposed spaced relation with portions of said rib and cooperating therewith to form a pocket opening towards the interior of the cover and spaced inwardly from the container rim.

2. A container and dome cover according to claim 1 wherein the container rib is defined by a pair of upstanding inner and outer walls interconnected by an elevated horizontal surface, and wherein said skirt member is defined by the ledge section extending laterally outwardly from a lower edge portion of said depending wall, and a leg section depending from an outer periphery of said ledge section and terminating at said flange, so that when said cover is in locking engagement with said container, the outer wall of said container rib is encompassed by and in substantial face to face engagement with the depending leg section of said cover and said ledge section and said rib horizontal surface are in substantially vertically aligned spaced relation and cooperate with an upper portion of the depending leg section to form the pocket with a substantially horizontally oriented laterally extending opening through which a peripheral portion of an insert board extends.

3. The combination of claim 1 wherein the top surface, depending wall, skirt member and flange of the dome cover have substantially uniform thickness.

* * * * *